US006139354A

United States Patent [19]

Broussard

[11] Patent Number: 6,139,354

[45] Date of Patent: Oct. 31, 2000

[54] CABLE COMPUTER TERMINATION CONNECTOR AND SEALING METHOD

[76] Inventor: Blaine L. Broussard, P.O. Box 401, Loreauville, La. 70552

[21] Appl. No.: 09/332,737

[22] Filed: Jun. 14, 1999

[51] Int. Cl.[7] ..... H01R 13/56

[52] U.S. Cl. ..... 439/447; 439/905

[58] Field of Search ..... 439/447, 445, 439/604, 320, 322, 323, 624, 905

[56] References Cited

U.S. PATENT DOCUMENTS 5,387,119 2/1995 Wood ..... 439/281

*Primary Examiner*—Brian Sircus
*Assistant Examiner*—Amir M Abdulmelik
*Attorney, Agent, or Firm*—Robert N. Montgomery

[57] ABSTRACT

An improved termination connector for seismic cable, the improvement including a reduced rigid length and improved flexibility by making connector to cable conductor splice connection within the bend restrictor, further reducing failure due to lateral stress through the use of a split collar and sleeve arrangement for connecting the connector's rotatable nut assembly to the connector body. The instant connector improves pin to cable makeup with improved pressure compensation splice connection process.

11 Claims, 6 Drawing Sheets

CABLE COMPUTER TERMINATION CONNECTOR AND SEALING METHOD

BACKGROUND OF THE INVENTION

1. Field of the Invention

This invention relates generally to underwater cable connector and more particularly to termination connectors for coupling inline computer systems within deep sea seismic cables and the improvement thereof for increasing flexibility pressurization sealing techniques.

2. General Background

Deep sea, seismic cable, inline amplifier computers are placed at intervals along the undersea cable's length. The cable is terminated at each end of the computer container and interchangeably connected to the computer with underwater high pressure connectors. The computer container and its two termination connectors generally comprise a near rigid body of approximately three-and one-half feet in length. Generally, the connector bodies further include removable, two piece, flexible bend restrictors which serve to prevent the cable from flexing too much and breaking the cable at or near the connector body. The bend restrictors allow the connector body to flex to some degree. However, too much bend tends to break the wire connections within the connector or breaks the sealing arrangement allowing water to enter the connector. Since the cable with its connectors, including the computer container, are paid-out and taken-up from a large reel system, it is essential that maximum flexure be provided and still maintain a watertight unbroken electrical connection. It is also essential that the wire splice termination be insulated and sealed within the connector in a manner whereby the termination seal is not broken as a result of high water pressure or sonic shock.

Heretofore, such under sea connectors experienced a high percentage of failure due to handling and inefficient sealing methods. Therefore, there is a need for improved connector design and sealing methods.

SUMMARY OF THE INVENTION

An Improved termination connector and sealing methods for an under sea, seismic cable computer. The connector includes an improved body design allowing improved flexure and reduced length over current designs and further includes improved methods for sealing internal connections and pressure compensation. The connector also includes a one piece, molded-in-place, bend restrictor with improved jacket and connector body seals. The molded in place bend restrictor provides the connector with a longer, flexible conductor makeup chamber. The connector body having a 20% shorter overall rigid length than all comparable connectors decreases the cable computer/connector assembly's overall bend radius requirement, thus reducing stress on the cable conductor connections within the connector's make-up chamber. The use of an improved, molded polymeric material for the bend restrictor and its sealing arrangement also provides greater flexibility and improved wear characteristics.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
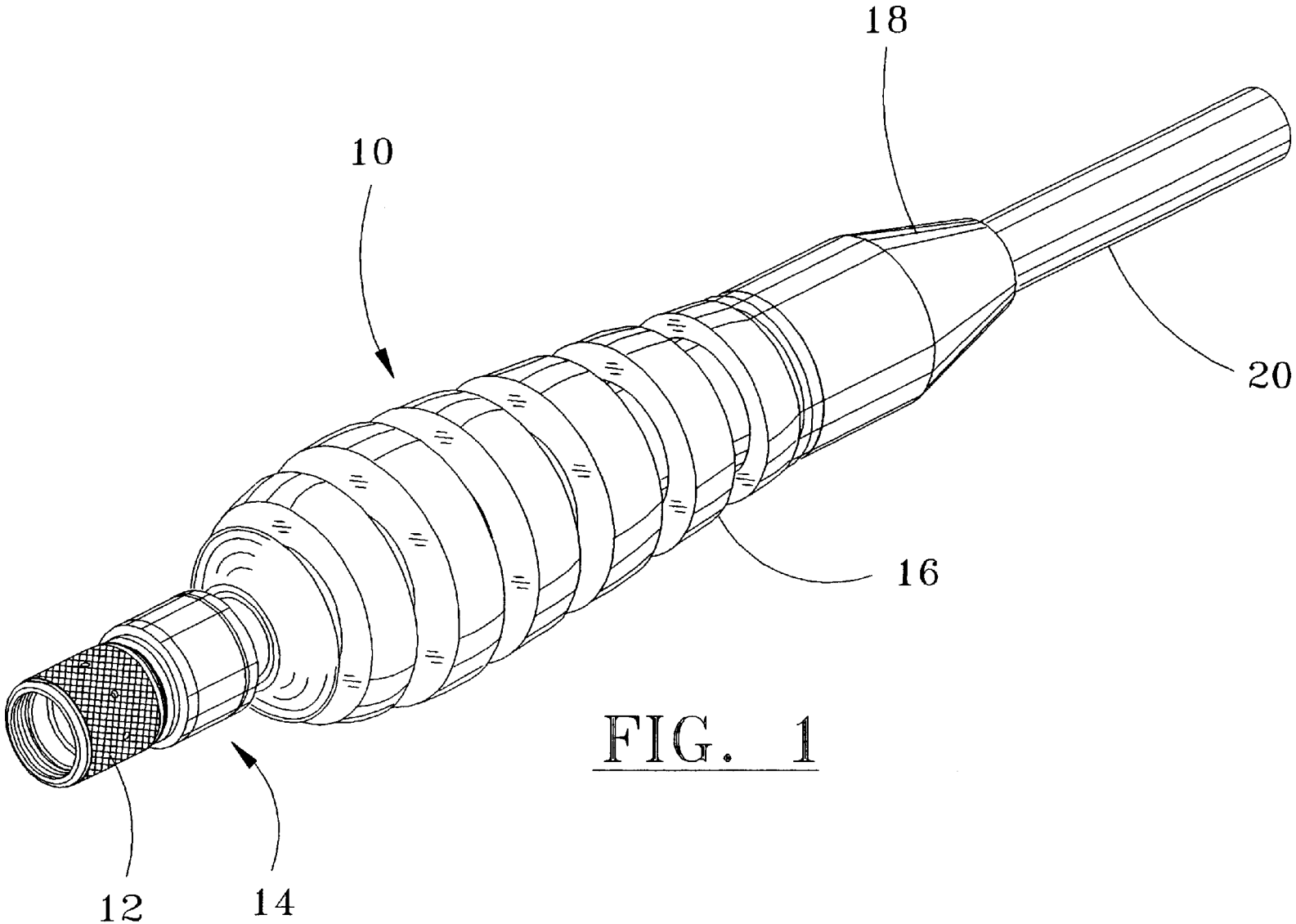
FIG. 1 is an isometric view of the preferred connector assembly.
Figures 2, 3:
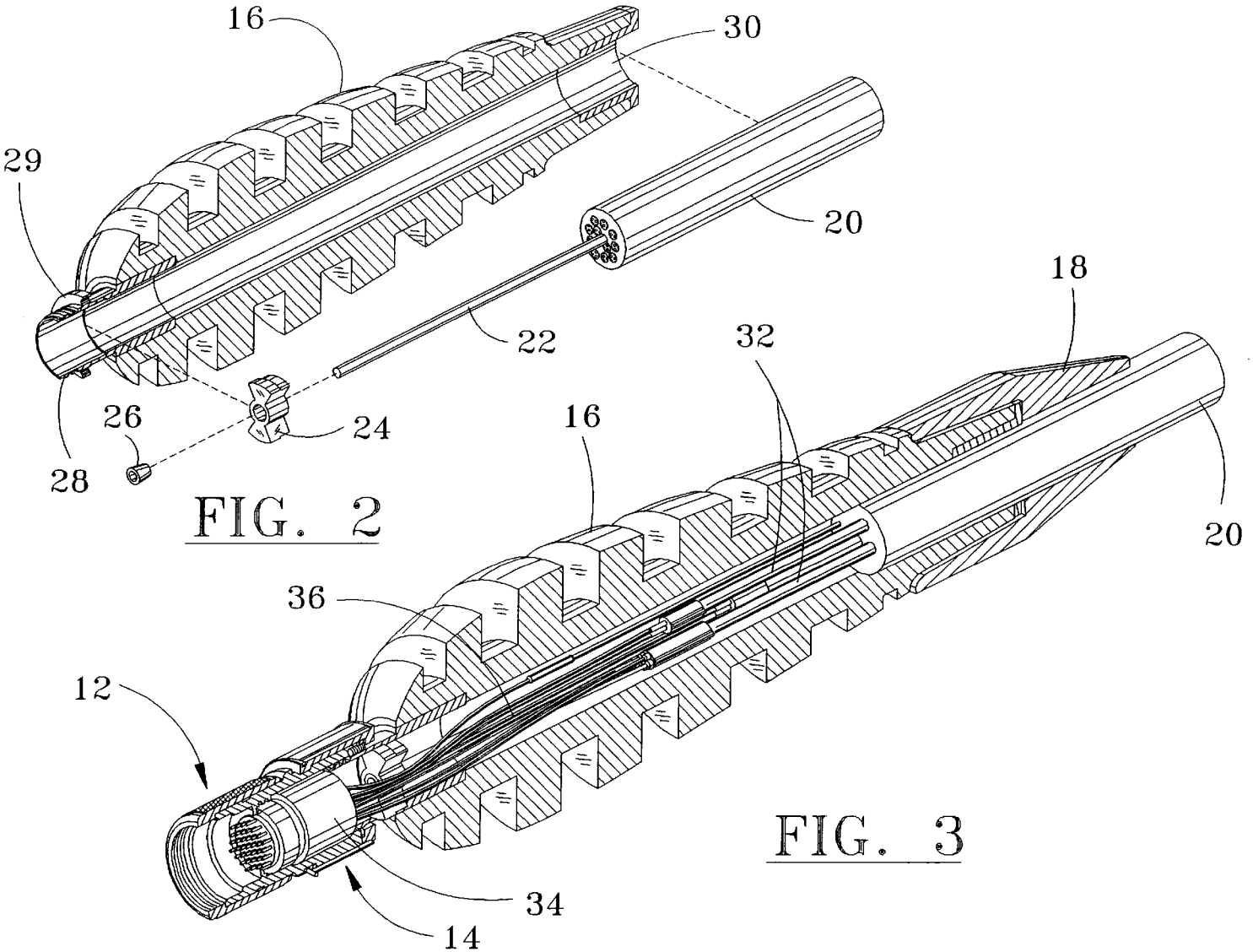
FIG. 2 is an isometric, partial cross section and partial assembly view of the preferred connector assembly.
FIG. 3 is an isometric, cross section view of the preferred embodiment and installation.
Figure 4:
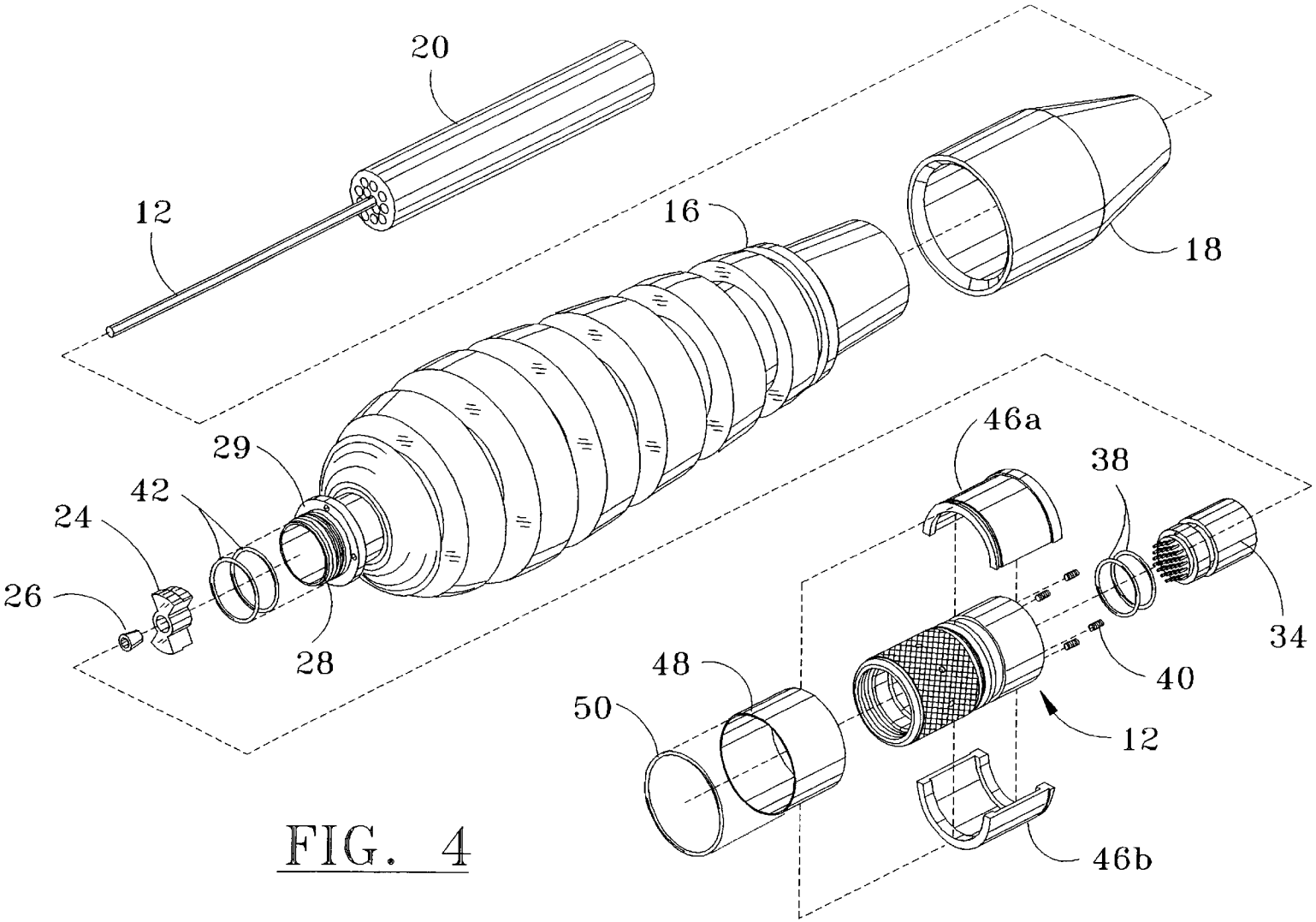
FIG. 4 is an isometric, exploded view of the preferred connector assembly.
Figures 5, 6, 7:
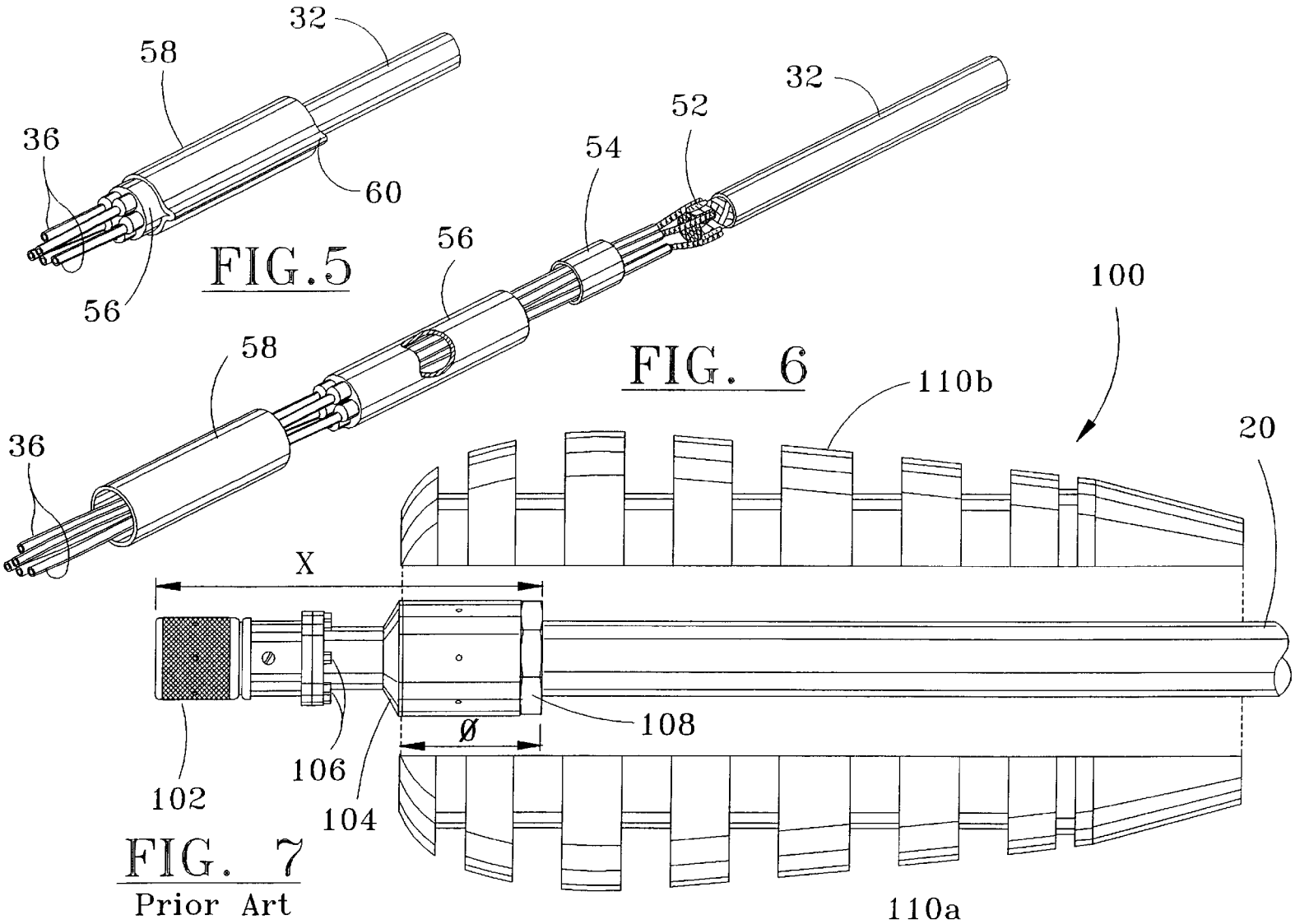
FIG. 7 Prior Art
FIG. 5 is an isometric view of a conductor connection assembly.
FIG. 6 is an isometric expanded view of a conductor connection assembly.
FIG. 7 is a side view illustration of a prior art connector assembly.

The preferred embodiment 10 as illustrated in FIG. 1 represents an improved version of the typical prior art connector assembly 100 illustrated in FIG. 7, the improvements and a comparison to be discussed in detail herein. Looking first at FIG. 1, the preferred embodiment or connector assembly 10 includes a high tensile steel rotatable nut assembly 12 retained on a connector body assembly 14 of the same material, a molded in one piece, flexible, bend restrictor 16, and a molded in place seal member 18 which positively seals the bend restrictor 16 to the cable's 20 jacket. As seen in FIG. 2, the multi-conductor cable 20 is retained within the flexible, one piece molded polymeric, bend restrictor by a central conductor 22, generally made of high tensile flexible material such as Kevlar™, passed through a retainer hub 24 and secured therein potted polymer lug 26, with the hub 24 being retained within the connector body 28 in the usual manner. It should be noted that the elongated, polymeric bend restrictor 16 is molded in a single piece having a tapering external body configuration over its length and a number of diametrical grooves formed therein for allowing maximum flexure within a limited range. The restrictor is also bonded, during the molding process, to the tubular, connector body member 28, having an external collar flange 29 having a series of transverse holes therein, and further bonded to a metal sleeve member 30 located internally at the restrictor's end opposite the connector body 28. Therefore, by sliding the bend restrictor 16 over the cable 20 to a point whereby the end of the cable is exposed beyond the connector body 28, the process for making up the connector assembly may begin. The multi-conductor cable 20 is then prepared by removing a portion of the cable's jacket and thus exposing the individual conductors 32, as seen in FIG. 3, for connection to a prepared pin connector 34 having multiple wire leads 36 extending therefrom. Turning now to FIG. 4, we see that the pin connector 34 fits within the rotatable nut assembly 12 in the usual manner as better seen in cross section in FIG. 8. The connector 34 is press fitted inside the rotatable nut assembly 12 and is further sealed with a pair of o-ring seals in the usuall manner.

The pin connector wires 36, as seen in FIG. 3, are mated to the wire conductors 32. In some cases the cable conductors 32 are quite large and relatively stiff and in some cases several pin connector wires 36 may be mated with a single cable conductor 32, as seen in FIG. 6, by making solder connection 52. A copper barrel 54 is also provided for crimping over the soldered connection 52. The connection is further fitted with a rubber or other polymeric type boot sleeve 56 which separately seals the pin wires relative to each other, covers the crimped barrel 54 and extends some distance along the conductor 32, thereby sealing the connection. Since the connector assembly 10 may be exposed to very high underwater pressure, a copper pressure barrel sleeve is provided and extended over the rubber boot 56 and crimped 60 as seen in FIG. 5 or by one of the several methods employed within the art, thus providing a means for pressure sealing the boot 56 thereby preventing any water inside the wire conductors from escaping into the connector body 28.

After the wire connection are made the nut assembly 12 is then mated to the connector body 28 such that the end portion of the nut assembly located opposite the rotatable nut is in slidable contact with the collar flange 29 located on the connector body 28 and prevented from rotation therewith by several set screws 40 or pins threadable inserted in the nut assembly the two bodies are further sealed with a pair of o-rings 42. It should be clearly understood that the nut assembly 12 and the connector body 28 are not secured to longitudinally, they are only prevented from rotation relative to each other. An external groove 44 is provided in the nut assembly 12 to accept a shoulder portion of split collar 46*a,*46*b* which when securely engaged around the nut assembly 12 and the connector body prevents longitudinal separation of the two bodies. The split collar 46*a,*46*b* is a split tubular having internal shoulders at each end and an external shoulder at one end and a ring grove at the opposite end. The split collar 46*a,*46*b* is secured around the two bodies 28,12 by a sleeve 48 and retained thereto by an o-ring 50. This split sleeve and collar arrangement improves the joint connection of the two bodies 102, 104 thus overcoming stress and shearing of the bolts 106 used for this connection as seem in the prior art FIG. 7. It should also be noted that some extra slack should be provided in the pin connector wires 36 to allow for flexure of the bend restrictor 16.

Figure 8:
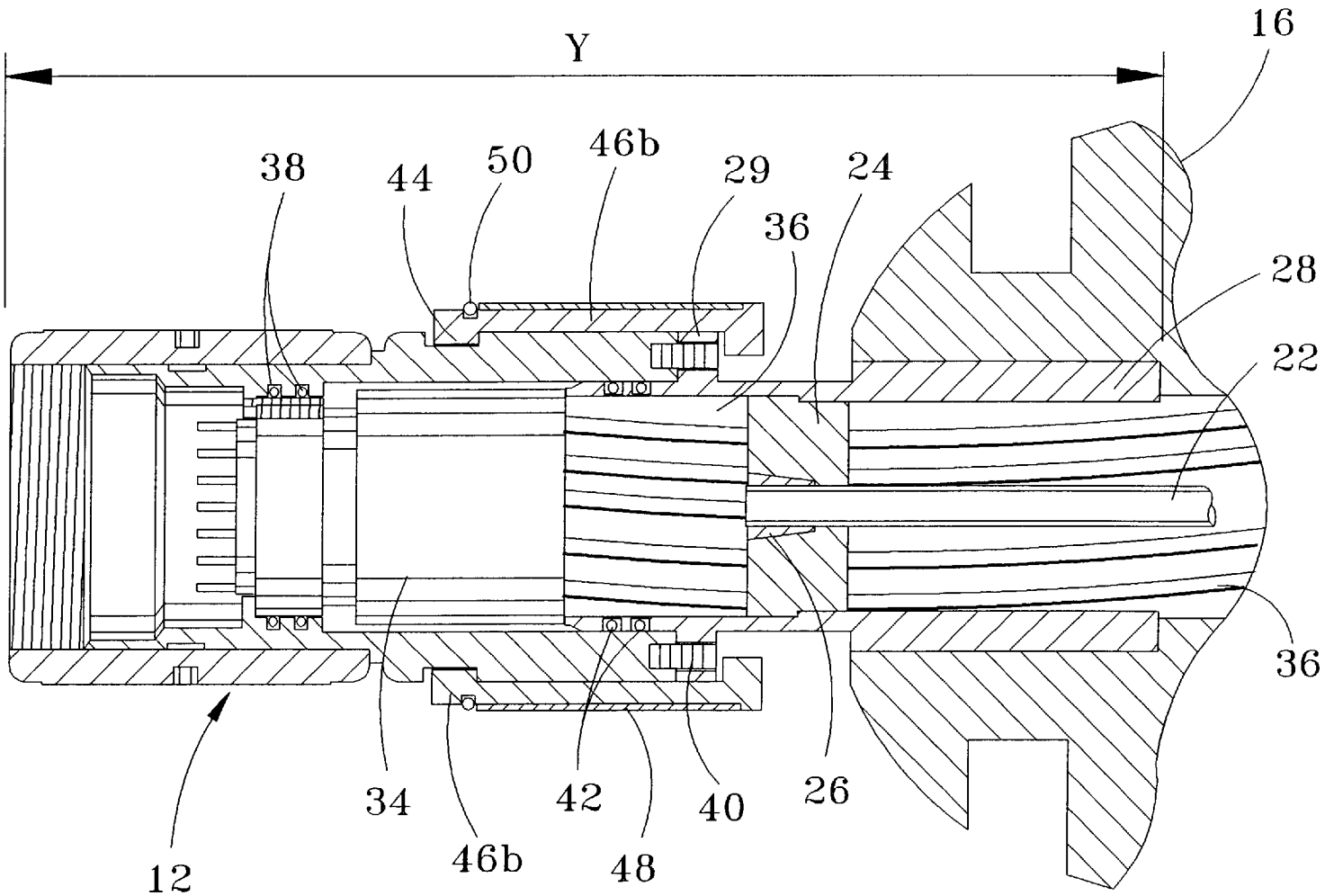
FIG. 8 is a partial cross section view of the preferred embodiment.
Figure 9:
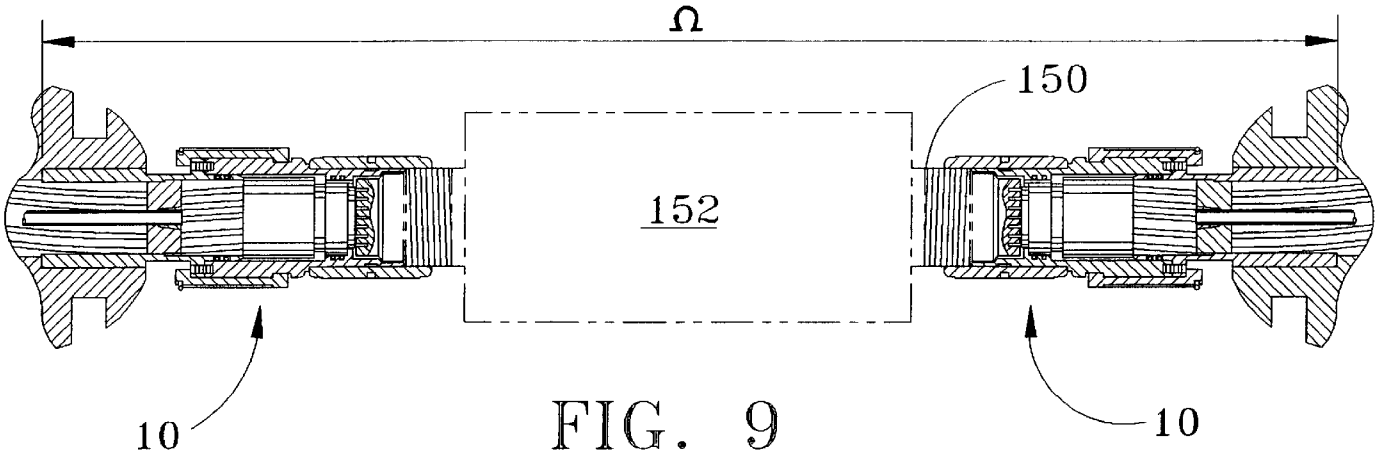
FIG. 9 is a partial cross section view of the preferred embodiment as installed.
Figure 10:
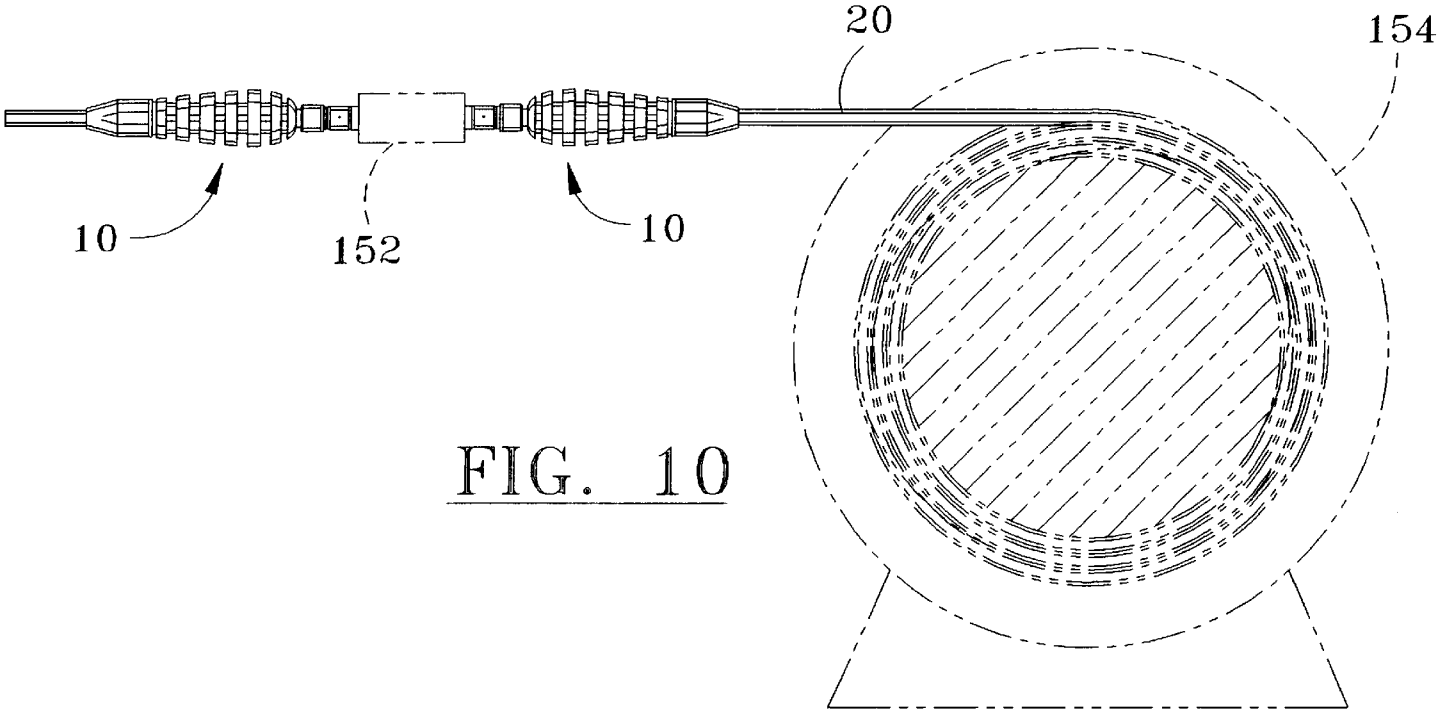
FIG. 10 is a side elevation of the preferred connector assemblies as installed and being wound on a spool.

As seen in FIG. 7, the connector body 104 utilizes a gland nut 108 to seal the connector body to the cable 20. The prior art bend restrictor 110 is made in two pieces 110*a* and 110*b* and simply fitted over the connector body 104 and secured to the cable 20 by banding the two halves together. No attempt is made to insure a watertight seal between the cable 20 and the bend restrictor 110*a,* 110*b,* whereas, the instant improved connector requires a watertight seal within the bend restrictor 16. The seal is perfected by molding in-place a seal member or boot 18, seen in FIG. 4, around the cable 20. The molded material adheres to the bend restrictor 16 and the cable's jacket by forming a molecular bond with the compounds of each, thus forming a permanent seal. This completes the assembly process of the termination connector. The distance Ø seen in FIG. 7 must necessarily be limited in the prior art, to hold the connector's rigid length X to a minimum in order to reduce stress on the connector itself and the termination connector 150 located on equipment such as the inline seismic computer seen in FIG. 9. However, the wire connectors and the stiffness of the cable wires generally require that the prior art fixed rigid length X to be approximately thirteen inches, whereas the instant connector as illustrated in FIG. 8 has a rigid length Y of only eight and five-eighths inches. Therefore, a considerable reduction in length is achieved by allowing the wire connections to extend beyond the connector body 28 to make-up within the one piece bend restrictor 16. Since two connector assemblies 12 are required at each joint, one terminating at each end of the computer 152 as seen in FIG. 9 an even greater saving is achieved in the over all rigid length Ω of approximately eight and three-quarters inches. This reduction in rigid length plays an important roll in reducing stress and thus eliminating connector failure in seismic cable termination joints. By reducing overall rigid length, a smaller bend radius is required when rolling the cable 20 onto a take-up reel 154 as shown in FIG. 10, thus increasing over all flexibility.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. An improved termination connector for seismic cable, inline computer connection of the type having a plurality of pins for mating with an electronic apparatus located at intervals along an underwater seismic cable, the improved connector assembly comprising:

a) a rotatable nut assembly;

b) a pin connector member fixed within a portion of said nut assembly;

c) a metal, tubular, connector body member having an external flange with a plurality of transverse holes therein, said body member being matable with said nut assembly;

d) a flexible, polymeric bend restrictor molded around a portion of said tubular body member;

e) a split collar and sleeve connecting said nut assembly to said connector body member;

f) a means located within said split collar and sleeve for preventing rotation of a portion of said nut assembly relative to said connector body member; and g) a sealing boot molded in-place around a portion of said bend restrictor opposite said tubular body.

2. The termination connector according to claim 1 wherein said rotatable nut assembly comprises a rotatable nut portion and a non-rotatable tubular portion, said non-rotatable portion having an external diametrical groove for receiving a mating portion of said split collar.

3. The termination connector according to claim 1 wherein said bend restrictor further comprises:

a) an elongated, external tapered body having a plurality of external diametrical grooves; and b) a metal sleeve bonded internally at end opposite said tubular body member.

4. The termination connector according to claim 3 wherein said split collar and sleeve comprises:

a) an elongated tubular collar member split diametrically into two equal parts, each part having an internal shoulder at each end and an external shoulder at one end with a external diametrical groove located adjacent an end opposite said external shoulder; and b) a sleeve member slidable externally upon said tubular collar; and c) a ring inserted in said external diametrical groove for locking said sleeve member to said collar member.

5. The termination connector according to claim 1 further comprises:

a) a means for restraining a portion of a cable having a plurality of wire conductors within said bend restrictor;

b) a connection means for connecting a plurality of wires to at least one of said conductors and to said pin connector member;

c) a polymeric boot for separating said wires and sealing said connection means; and d) a tubular metal sleeve placed slidably over said polymeric boot and crimped thereon to provide a high pressure seal.

6. The termination connector according to claim 2 wherein said nut assembly further comprises a plurality of set screws threadably inserted in said non-rotatable tubular portion in a manner wherein said set screws mate with said transverse holes in said connector body member flange.

7. A sub-sea seismic cable connector assembly and cable termination connection comprising:

a) a sub-sea seismic cable having a plurality of conductors of varying size sealed inside a polymeric jacket;

b) a flexible, elongated, tubular, polymeric bend restrictor having proximate and distal ends and a tapering external body configuration with a plurality of grooves therein;

c) a metal sleeve member molded internally and longitudinally adjacent said proximate end and a portion of a tubular connector body member molded internally and longitudinally adjacent said distal end, an exposed portion of said connector body member further comprising an external flange having transverse holes therein;

d) a means for retaining a portion of said seismic cable within said bend restrictor;

e) a connector pin member having a plurality of wire leads sealed and extending therefrom;

f) a means for connecting and sealing at least one of said wire leads to at least one of said conductors in said seismic cable;

g) a means for compression sealing said means for sealing;

h) a rotatable nut assembly having a rotating portion and a non-rotatable tubular portion matable with said connector body member;

i) a split collar and sleeve means for coupling said rotatable nut assembly and said connector body member, j) a means located within said split collar and sleeve for preventing rotation of non-rotating portion of said nut assembly relative to said connector body member; and k) a molded in place polymeric boot, molecular bonded to said bend restrictor and said polymeric jacket.

8. A sub-sea seismic cable connector assembly and cable termination connection according to claim 7 wherein connections between said pin connector wire leads and said cable conductors are located and sealed within said bend restrictor.

9. A sub-sea seismic cable connector assembly and cable termination connection according to claim 7 wherein said means for connecting and sealing at least one of said wire leads to at least one of said conductors in said seismic cable includes:

a) a connection means for connecting a plurality of wires to at least one of said conductors;

c) a polymeric boot for separating said wires and sealing said connection means; and d) a tubular metal sleeve placed slidably over said polymeric boot and crimped thereon to provide said compression seal.

10. A sub-sea seismic cable connector assembly and cable termination connection according to claim 7 wherein said means for coupling said rotatable nut assembly and said connector body member comprises:

a) an elongated tubular collar member split diametrically into two equal parts, each part having an internal shoulder at each end and an external shoulder at one end with a external diametrical groove located adjacent an end opposite said external shoulder; and b) a sleeve member slidable externally upon said tubular collar; and c) a ring inserted in said external diametrical groove for locking said sleeve member to said collar member.

11. A sub-sea seismic cable connector assembly and cable termination connection according to claim 7 wherein said means for preventing rotation of non-rotating portion of said nut assembly relative to said connector body member comprises a plurality of set screws threadably inserted in said non-rotatable tubular portion in a manner wherein said set screws mate with said transverse holes in flange of said connector body member.

* * * * *